US006041716A

United States Patent [19]

Alibozek

[11] Patent Number: 6,041,716

[45] Date of Patent: Mar. 28, 2000

[54] TIRE TABLE LEG AND TABLE

[76] Inventor: Timothy Alibozek, 159 Burlingame Hill, Adams, Mass. 01220

[21] Appl. No.: 08/929,002

[22] Filed: Sep. 6, 1997

[51] Int. Cl.[7] ..... A47B 23/00

[52] U.S. Cl. ..... 108/44; 108/157.15

[58] Field of Search ..... 108/157.15, 157.17, 108/157.16, 157.1, 161, 44; 297/217.1, 463.2; 248/346.01; 224/539, 540, 42.12, 42.13, 42.15; 296/37.1; 280/DIG. 6

[56] References Cited

U.S. PATENT DOCUMENTS

| | | | |
|---|---|---|---|
| 1,904,897 | 4/1933 | Kahrs | 108/157.1 X |
| 2,610,072 | 9/1952 | Head | 297/217.1 X |
| 3,633,519 | 1/1972 | Nichol | 297/217.1 X |
| 4,099,771 | 7/1978 | Mathews | 297/217.1 X |
| 4,403,806 | 9/1983 | Stephen | 297/217.1 |
| 5,706,991 | 1/1998 | Stewart | 108/44 X |

*Primary Examiner*—Jose V. Chen
*Attorney, Agent, or Firm*—Donald S. Holland, Esq.; Holland & Bonzagni, P.C.

[57] ABSTRACT

A table has a base, a tire table leg as a vertical support, and a surface top. The tire table leg is vertically disposed with the tire leg's side walls as the vertical lateral sides. The tire table leg has an upper portion and a lower portion. A base bracket fastens to the lower portion, which in turn can be fastened to a base. The base bracket has fastener surfaces for fastening to the tire's lower portion. A surface top bracket fastens to the tire's upper portion, which in turn can be fastened to a surface top. The surface top bracket has opposite fasteners that are spaced and angled to fit against the road contact surface area of the tire table leg. Also, a tire brace matching the internal curvature of the tire leg's inner periphery area may be fit there against to provide vertical strength to the tire table leg.

20 Claims, 7 Drawing Sheets

TIRE TABLE LEG AND TABLE

FIELD OF THE INVENTION

The present invention relates to table legs and tables, and more specifically to a tire table leg, and a table that comprises at least one tire table leg.

BACKGROUND OF THE INVENTION

When disposed on its road contact surface, a tire, in light of its circular shape, cannot stand or support a surface top in a stable, steady, sturdy, or unwobbly fashion. But with modification, the tire can be adapted to function as a table leg. In fact, a table or stand can be made using a tire table leg modified appropriately.

Consequently, it is an objective of the present invention to use a tire, such as a racing, automobile, or truck tire, as a vertical leg support for a stand or table. It is a further objective of the present invention to provide a tire table leg that is stable, steady, sturdy and has minimal wobbliness. It is a further objective of the present invention to provide a stand or table where one or more tires can be used to provide vertical support. It is a further objective of the present invention to display a tire in a useful and practical manner. These and still further objectives will become apparent hereinafter.

SUMMARY OF THE INVENTION

The foregoing objectives are realized by providing a tire with appropriate brackets to enable the tire to stand and function as a table leg. Further, a table or stand can be made with the combination of one or more tire table legs and a surface top. For the present invention, an appropriate tire would have opposite side walls, an interior periphery, and a road contact surface (comprising the outer circumference or periphery). Disposed or stood on its road contact surface, the tire table leg would comprise top and bottom portions, with its side walls being the vertical sides.

In one mode of practicing the present invention, a base bracket and a surface top bracket attach to the tire's bottom and top portions respectively. Each bracket comprises fastener surfaces spaced to fasten to respective portions of a tire's road contact surface. The base and surface top brackets have means for attaching to a leg support base and a surface top respectively. To provide greater stability or adjust the overall height of the tire table leg, the top portion can be cut to present a flat area. In such situation, the surface top bracket would fit thereover, with the fastener surfaces fastening to respective portions of the tire's road contact surface defining the flat area.

In another mode of practicing the present invention, a tire brace adapted to fit around at least portions of the tire leg's interior periphery can be fitted thereagainst. The tire brace would provide additional vertical support. In the preferred embodiment, the brace comprises two length members. Each length member is curved to match the curvature of the portion of the interior periphery respective to each member.

In another mode of practicing the present invention, a stand or table is made that comprises the combination of one or more of the tire table leg, a base for the tire table leg, and a surface top.

DETAILED DESCRIPTION OF THE INVENTION

Figure 1:
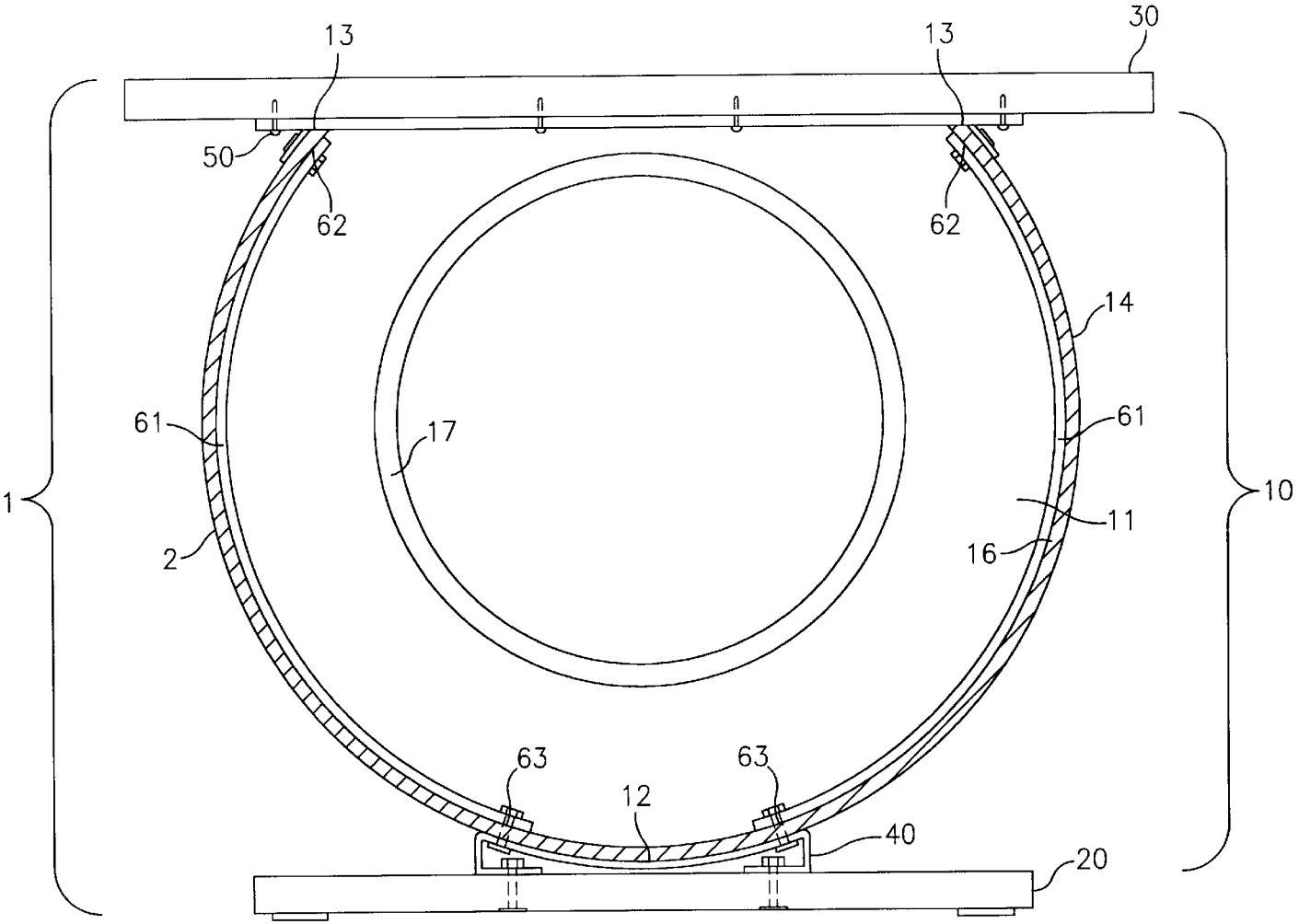
FIG. 1 is a lateral side cutaway view of one embodiment of the present invention, showing a table comprising a tire table leg vertically disposed with the tire table leg's side walls as the vertical lateral sides, a base and a surface top.

An in depth description of the invention and the preferred embodiment is now in order. With reference to the drawings, like reference characters designate like or corresponding parts throughout the several views.

Referring to FIG. 1, tire 2 has opposite sidewalls 11, road contact surface 14 comprising the tire's outer periphery, and interior periphery 16. Stand 1 comprises tire table leg 10, vertically disposed with tire 2's opposite side walls 11 being the vertical lateral sides, base 20, and surface top 30. Tire table leg 10 comprises tire 2, base bracket 40 attached about tire table leg 10's bottom portion 12, and surface top bracket 50 attached about tire table leg 10's top portion 13. Base 20 attaches to base bracket 40 and surface top 30 attaches to surface top bracket 50.

Figure 2:
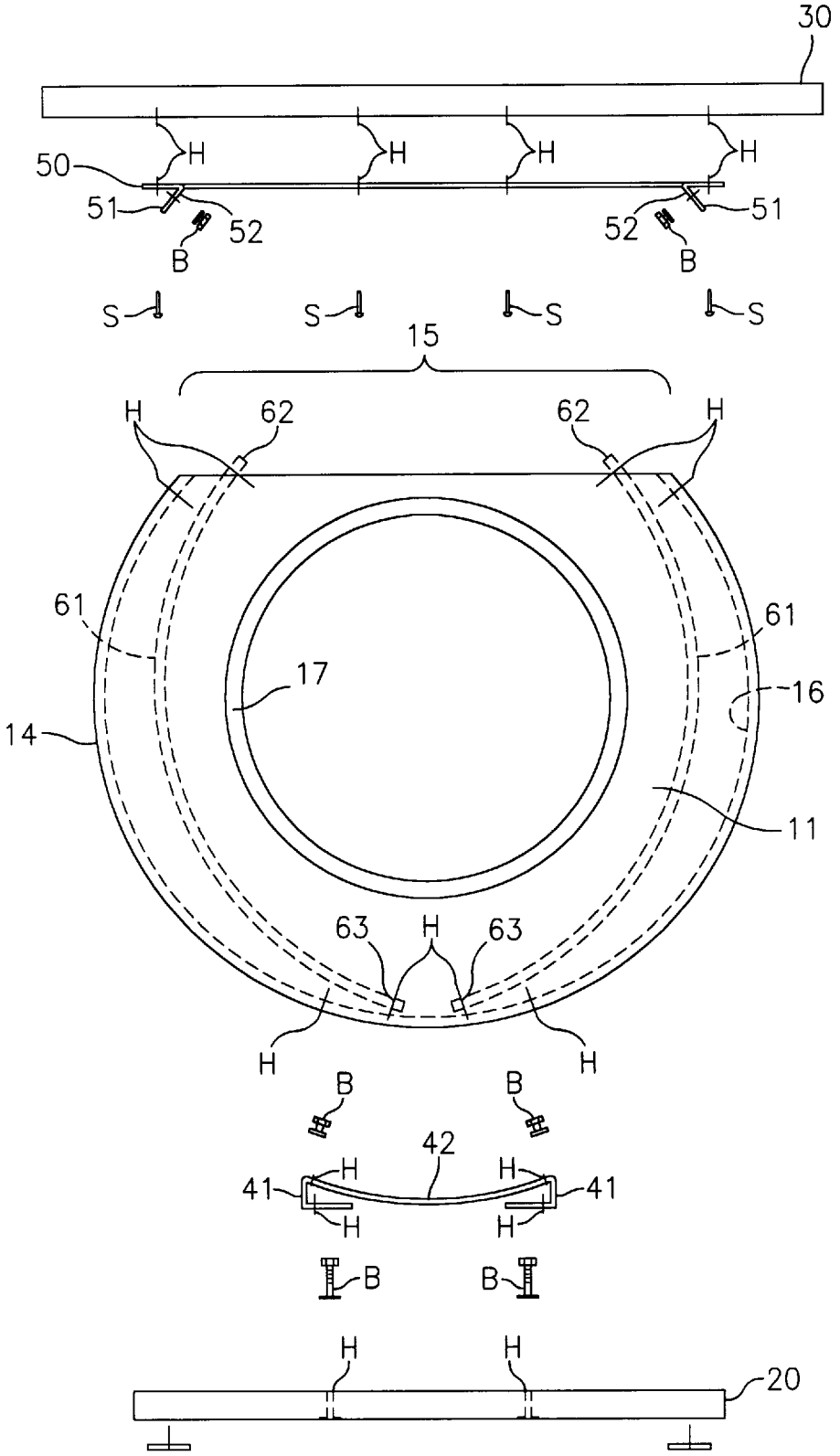
FIG. 2 is an exploded and lateral side cutaway view of one embodiment of the present invention, showing a table, comprising a tire table leg vertically disposed, a base, and a surface top.
Figure 3:
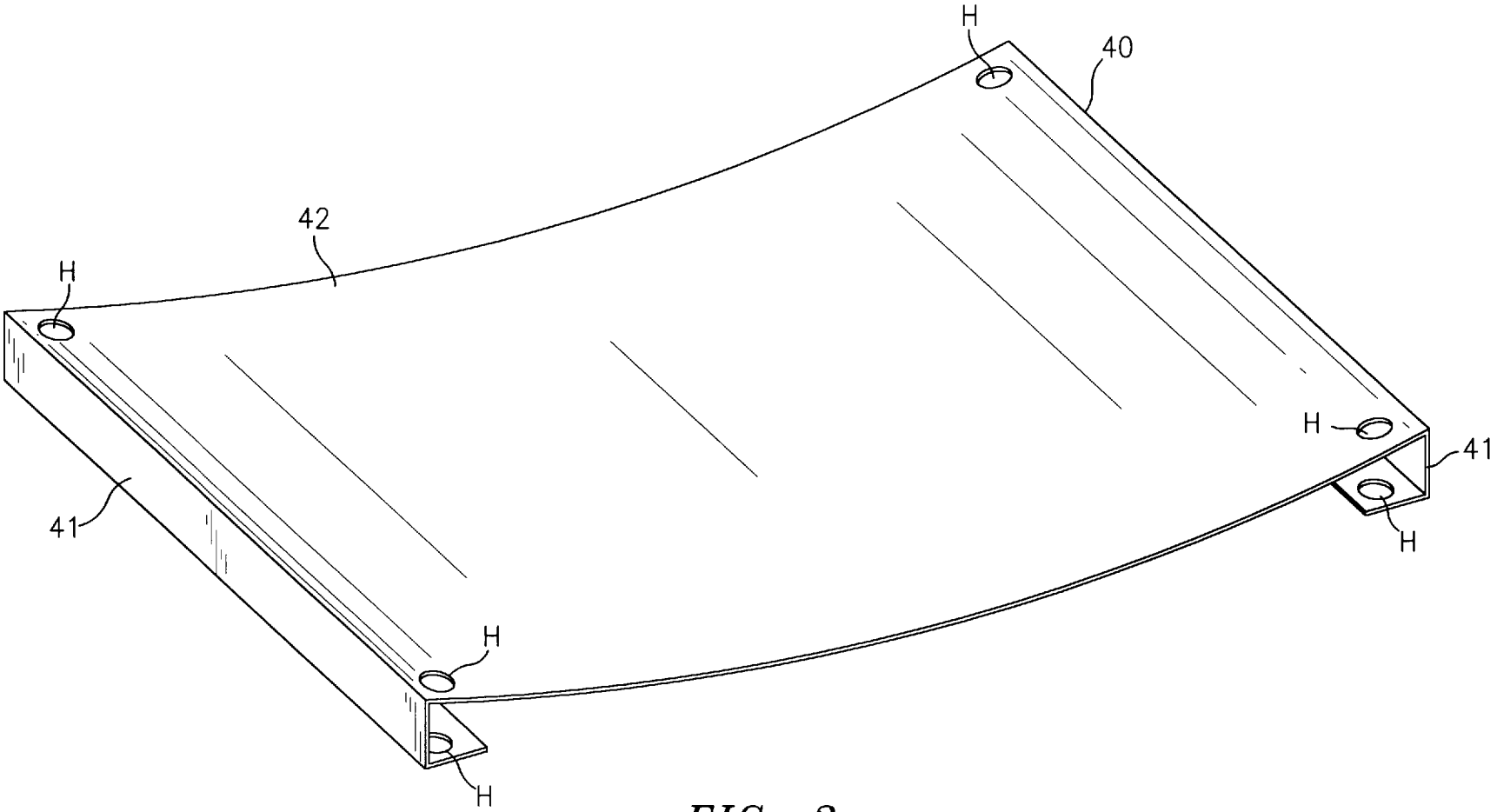
FIG. 3 is a perspective view of one embodiment of a bottom base bracket.
Figure 4:
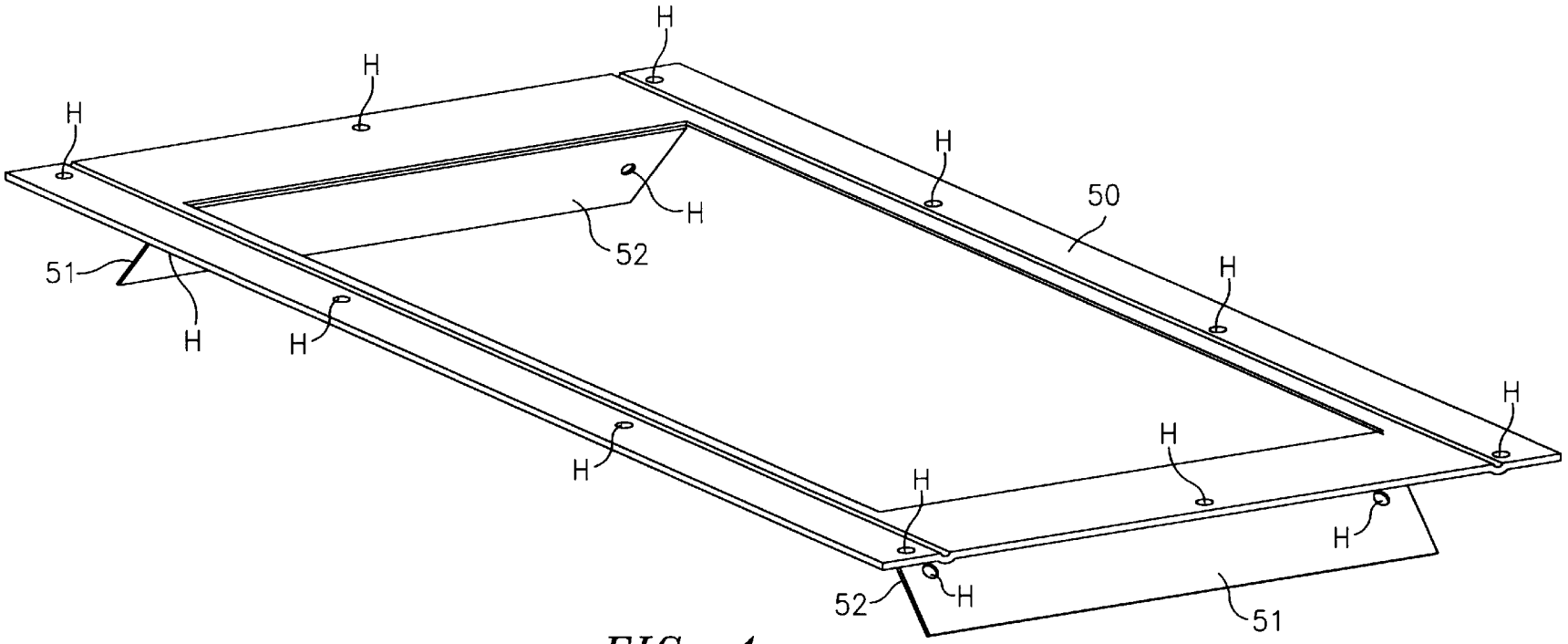
FIG. 4 is a perspective view of one embodiment of a surface top bracket.

Referring to FIG. 2, base bracket 40 comprises fastener surface 42 for fastening to portions of tire 2's road contact surface 14. Fastening surface 42 reciprocally matches the curvature of the respective portions of tire 2's road contact surface 14 to which each fastening surface 42 fastens. Fastening surface 42 has holes H alignable with holes H of the respective portion of tire 2's road contact surface 14 to which fastener surface 42 fastens, wherein bolts B insert therethrough and are locked (whether via nuts or some other locking means) for fastening base bracket 40 and tire table leg 10's bottom portion 12 together. Base bracket 40 has legs 41 with holes H alignable with holes H of base 20, wherein bolts B insert therethrough and are locked for fastening base 20 and base bracket 30 together. Because base bracket 40's fastener surface 42 encompasses the bottom portion 12 of tire 2, opposite portions of tire 2's road contact surface can be fastened to minimize wobbliness of base 20 when attached to base bracket 40.

Referring to FIG. 2, surface bracket 50 comprises fastener portions 51. Fastener portions 51 are disposed horizontally opposite to each other and comprise fastening surfaces 52 for fastening to portions of tire 2's road contact surface 14. Fastener portions 51 are angled away from the perpendicular in order to align at least approximately with the curvature of tire 2 to enable fastener surfaces 52 to fit against respective portions of road contact surface 15. Fastening surfaces 52 can be made to match reciprocally the curvature of the respective portions of tire 2's road contact surface 14 to which each fastening surface 52 fastens. Each fastening surface 52 has holes H alignable with holes H of the respective portion of tire 2's road contact surface 14 to which each fastener portion 51 fastens, wherein bolts B insert therethrough and are locked (whether via nuts or some other locking means) for fastening surface top bracket 50 and tire table leg 10's top portion 13 together. Surface bracket 50 has holes H alignable with holes H of surface top 30, wherein bolts B insert therethrough and are locked for fastening surface top 30 and surface top bracket 50 together. Because surface top bracket 50's fastener portions 51 are disposed horizontally opposite to each other, opposite portions of tire 2's road contact surface can be fastened to minimize wobbliness of surface top 30 when attached.

Top portion 13 can comprise a flat horizontal area, in which case surface bracket 50 would fit thereover. In such an embodiment, as best shown in FIG. 2, flat area 15 results from cutting off or removing a portion of tire 2 to provide a flat, horizontal area. For the embodiment shown in FIG. 2, top portion 13 would therefore comprise the flat surface ends of top portion 13 (after a portion of tire 2 has been cut off or removed) and that area delimited therebetween and planar therewith. Thus, for the embodiment of FIG. 2, flat area 15 would also comprise the flat surface ends of top portion 13 (after a portion of tire 2 has been cut off or removed) and that area delimited therebetween and planar therewith. Of course, if the material comprising the road contact surface is sufficiently thick (tire dependent and amount cut off dependent), then flat area 15 could also be a flat surface. Surface bracket 50 would fit over flat area 15.

Figure 5:
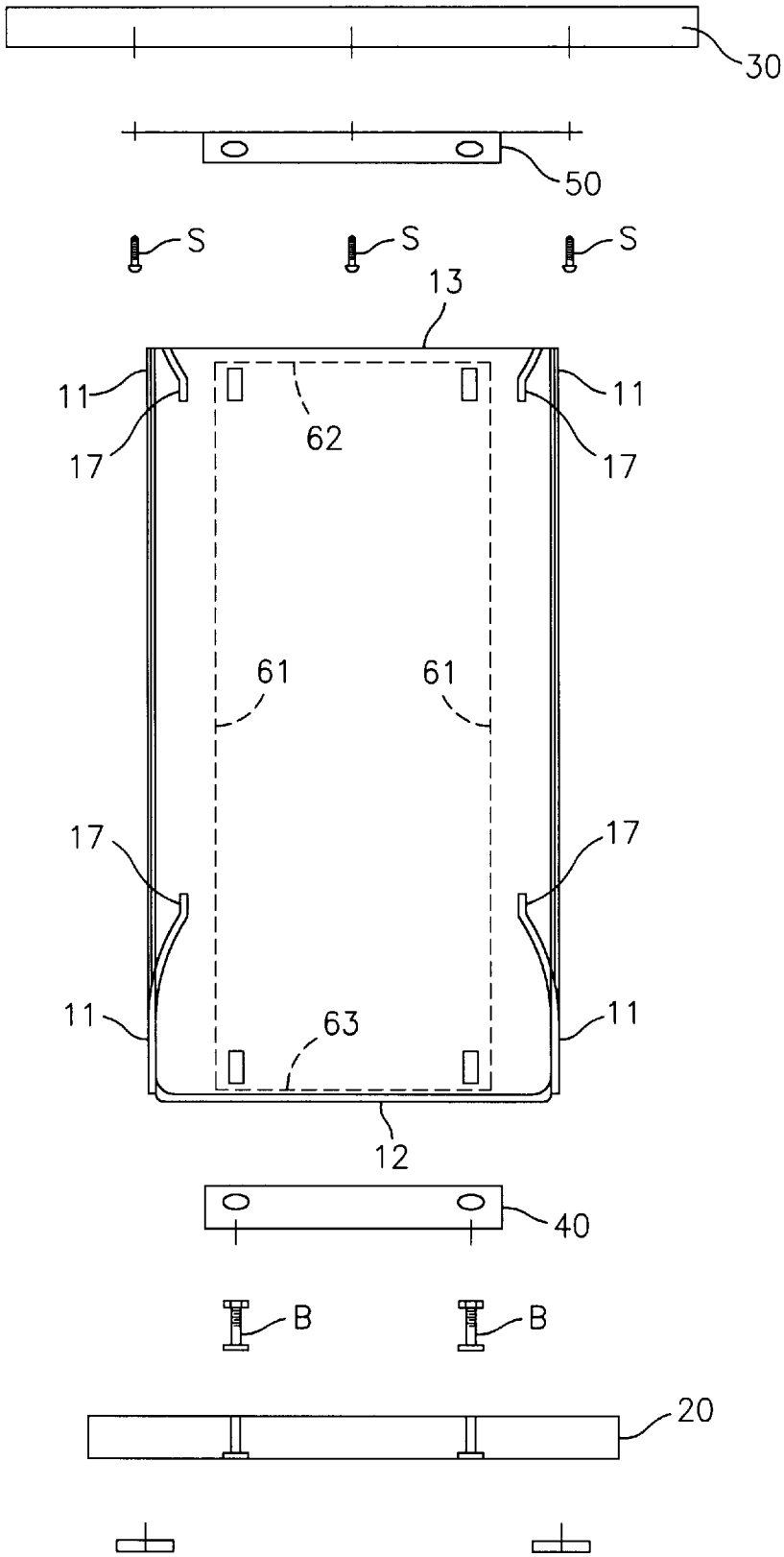
FIG. 5 is an exploded and a cutaway view of one embodiment of the present invention, as viewed toward the tire's road contact surface, showing a table comprising a tire table leg vertically disposed, a base, and a surface top, with a tire support brace.
Figure 6:
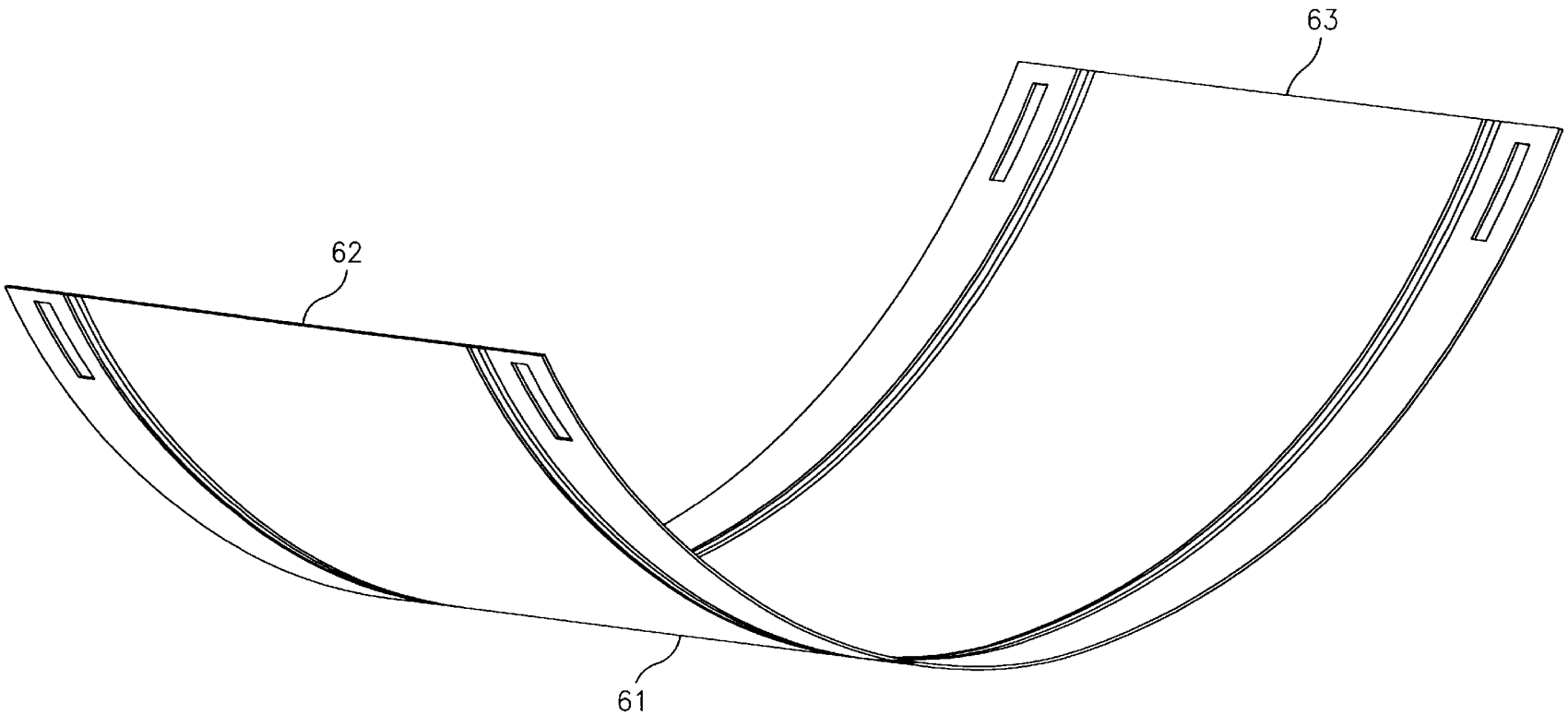
FIG. 6 is a perspective view of one embodiment of a brace length member.
Figure 7:
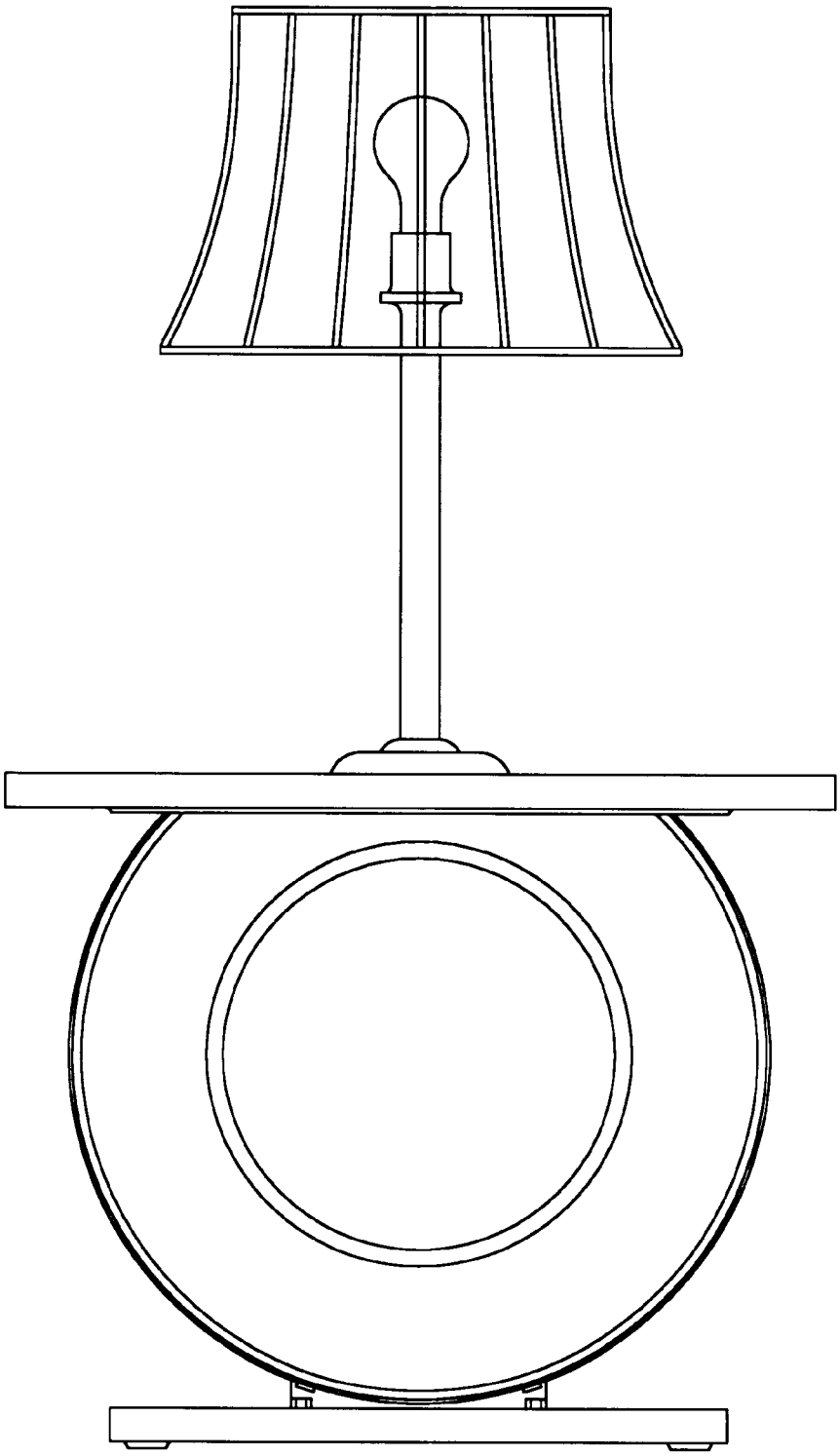
FIG. 7 shows one embodiment of a table and a lamp stand comprising a tire table leg.

In another embodiment of the present invention, referring to FIG. 5 and FIG. 6, tire brace 60 can be fitted inside tire 2's interior periphery 16 to provide additional vertical strength for tire table leg 10. For the embodiments shown and deemed the best mode, tire brace 60 comprises two length members 61 for fitting against opposite portions of interior periphery 16. Each length member 61 is curved lengthwise to matched the interior periphery curvature of tire table leg 10. Length members 61 extend along and against opposites sides of tire table leg 10's interior periphery area. Each length member 61's first end portion 63 fits within and against tire table leg 10's bottom portion 12's interior periphery area respective thereto and is fastened via a bolt B (and locked via a nut or some other locking means) inserted through hole H alignable with holes H of base bracket 40 and tire table leg 10's bottom portion 12 respective thereto. Each length member 61's second end portion 62 fits within and against tire table leg 10's top portion 13's interior periphery area respective thereto, and is fastened via a bolt B (and locked via a nut or some other locking means) inserted through hole H alignable with holes H of tire table leg 10's road surface areas 14 and fastener portions 51 respective thereto.

It is understood by those skilled in the art that tire 2 can comprise any tire, as examples, a racing car tire, an automobile tire, a truck tire, a tractor tire.

While the preferred embodiment of the invention has been disclosed and described, further modifications of the invention herein disclosed will occur to those skilled in the respective art and all such modifications are deemed to be within the scope of the invention as defined by the appended claims.

What is claimed is:

1. A tire table leg comprising:

a. a tire having opposite side walls, an interior periphery, a road contact surface as the outside periphery of said tire, an upper area and a lower area;

b. a base bracket having fastener surfaces respectively fastened to portions of said tire's road contact surface of said tire's lower area; and c. a surface top bracket having fastener surfaces respectively fastened to portions of said tire's road contact surface of said tire's upper area.

2. The tire table leg of claim 1 wherein:

a. said base bracket further comprises a support area with which a portion of said tire's road contact surface of said tire's lower area fits; and b. said surface top bracket further comprises a fit area with which a portion of said tire's road contact surface of said tire's upper area fits.

3. The tire table leg of claim 2 wherein said base bracket support area is reciprocally matched to the curvature of that portion of said tire's road contact surface of said tire's lower area with which said base bracket support area fits.

4. The tire table leg of claim 3 wherein said surface top bracket fit area is reciprocally matched to the curvature of that portion of said tire's road contact surface of said tire's upper area with which said surface top bracket fit area fits.

5. The tire table leg of claim 1 further comprising a tire support brace for fitting against at least a portion of said tire's interior periphery, said tire support brace being curved to match at least approximately the curvature of said tire's interior periphery portion.

6. The tire table leg of claim 5 wherein:

a. said brace comprises two brace members, each brace member for fitting against at least a respective portion of said tire's interior periphery; and b. each member is curved to match at least approximately the curvature of that portion of said tire's interior periphery respective to said member.

7. The tire table leg of claim 6 wherein a portion of said road contact surface of said tire's upper area has been removed to present a flat area, said surface top bracket fitting over said flat area.

8. The tire table leg of claim 6 wherein:

a. said base bracket further comprises a support area with which a portion of said tire's road contact surface of said tire's lower area fits, said base bracket fastener surfaces being spaced and positioned on said base bracket to provide space for said portion of said tire's road contact surface of said tire's lower area to fit with said support area; and b. said surface top bracket further comprises a fit area with which a portion of said tire's road contact surface of said tire's upper area fits, said surface top bracket fastener surfaces being spaced and positioned on said base bracket to provide space for said portion of said tire's road contact surface of said tire's upper area to fit with said fit area.

9. The tire table leg of claim 1 wherein a portion of said road contact surface of said tire's upper area has been removed to present a flat area, said surface top bracket fitting over said flat area.

10. A table or stand comprising a leg, a base, and a surface top, said leg comprising a tire, a base bracket, and a surface top bracket, said tire comprising opposite side walls, an interior periphery, and road contact surface area as said tire's outer periphery, wherein:

a. said leg is vertically disposed with the vertical lateral sides of said leg being said tire's side walls to provide a top portion of said leg and a bottom portion of said leg;

b. said leg's bottom portion and said base bracket are attached, and said leg's top portion and said surface top bracket are attached; and c. said base bracket and said base are attached, and said surface top bracket and said surface top are attached.

11. The table or stand of claim 10 wherein:

a. said base bracket comprises fastener surfaces respectively fastened to portions of said tire's road contact surface of said tire's bottom portion; and b. said surface top bracket comprises fastener surfaces respectively fastened to portions of said tire's road contact surface of said tire's top portion.

12. The table or stand of claim 11 wherein:

a. said base bracket further comprises a support area with which a portion of said tire's road contact surface of said tire's bottom portion fits; and b. said surface top bracket further comprises a fit area with which a portion of said tire's road contact surface of said tire's top portion fits.

13. The table or stand of claim 12 wherein said base support area is reciprocally matched to the curvature of that portion of said tire's road contact surface with which said base support area fits.

14. The table or stand of claim 10 wherein said tire table leg further comprises a tire support brace for fitting against at least a portion of said tire's interior periphery, said tire support brace being curved to match the curvature of said tire's interior periphery portion.

15. The table or stand of claim 14 wherein:

a said brace comprises two brace members, each brace member having a length for fitting against at least a portion of said tire's interior periphery; and b. each member is curved to match the curvature of that portion of said tire's interior periphery respective to said member.

16. The table or stand of claim 15 wherein a portion of said road contact surface of said tire's top portion has been removed to present a flat area, said surface top bracket fitting over said flat area.

17. The table or stand of claim 10 wherein a portion of said road contact surface of said tire's top portion has been removed to present a flat area, said surface top bracket fitting over said flat area.

18. A stand or table comprising a leg, a base, and a surface top, said leg comprising a tire having opposite side walls, an interior periphery, and road contact surface area, wherein:

a. said leg is vertically disposed with the vertical lateral sides of said leg being said tire's side walls to provide a top portion of said leg and a bottom portion of said leg;

b. said base comprises a support area with which a portion of said tire's road contact surface of said tire's lower portion fits and fastening means for fastening said base and said tire's bottom portion together, said base fastening means comprising fastener surfaces spaced for fastening to respective portions of said tire's lower portion; and c. said surface top comprises a fit area with which a portion of said tire's road contact surface of said tire's upper portion fits and fastening means for fastening said surface top and said tire's upper portion together, said surface top fastening means comprising fastener surfaces spaced for fastening to respective portions of said tire's upper portion.

19. The stand or table of claim 18 wherein a tire support brace is fitted against at least a portion of said tire's interior periphery, said tire support brace being curved to match at least approximately the curvature of said tire's interior periphery portion, said tire support brace comprising two brace members, each brace member having a length for fitting against at least a portion of tire's interior periphery, and each support brace member being curved to match at least approximately the curvature of that portion of said tire's interior periphery respective to each support brace member.

20. The stand or table of claim 19 wherein a portion of said road contact surface of tire's upper portion has been removed to present a flat area, said surface top fitting over said flat area.

* * * * *